United States Patent [19]

Charbonnier

[11] Patent Number: 4,777,998

[45] Date of Patent: Oct. 18, 1988

[54] MACHINE FOR PRESSURE CASTING OF METAL PARTS POSSIBLY CONTAINING FIBRES OF CERAMIC MATERIALS

[75] Inventor: Jean Charbonnier, Rives, France

[73] Assignee: Aluminium Pechiney, Paris, France

[21] Appl. No.: 112,078

[22] Filed: Oct. 26, 1987

[30] Foreign Application Priority Data

Oct. 31, 1986 [FR] France ..... 86 15437

[51] Int. Cl.[4] ..... B22D 17/04

[52] U.S. Cl. ..... 164/259; 164/312

[58] Field of Search ..... 164/312, 306, 309, 316, 164/259, 113, 119, 66.1

[56] References Cited

U.S. PATENT DOCUMENTS 3,980,125 9/1976 Portalier ..... 164/309

4,633,930 1/1987 Behrens ..... 164/312

FOREIGN PATENT DOCUMENTS 57-97860 6/1982 Japan ..... 164/66.1

*Primary Examiner*—Kuang Y. Lin

*Attorney, Agent, or Firm*—Dennison, Meserole, Pollack & Scheiner

[57] ABSTRACT

The invention relates to an apparatus for pressure casting of metal parts which possibly contain fibres of ceramic material. The apparatus includes a cold chamber, and comprises a lower fixed plate 1, an upper movable plate 2, and a die 3 disposed between the upper plate and the lower plate, with the lower plate being provided with an injection means for liquid metal comprising an injection sleeve 5 having a piston 6 supported on a rod 7 slidable in the sleeve. The metal is contained in a sealed vessel connected to the injection sleeve by a conduit 9 by way of an orifice 8 in the sleeve, with a gas inlet in the vessel connected to a source of gas for selectively placing the liquid metal in the vessel under a gas pressure P2 which causes the flow of liquid metal in the conduit towards the sleeve. A second gas inlet is located in the conduit near the orifice, this second gas inlet able to selectively create a gas pressure P1 in a pocket adjacent to the inlet, depending on the position of the piston and the gas pressure P2.

4 Claims, 2 Drawing Sheets

MACHINE FOR PRESSURE CASTING OF METAL PARTS POSSIBLY CONTAINING FIBRES OF CERAMIC MATERIALS

The present invention relates to a machine for pressure casting of metal parts, in particular of aluminium and lithium alloys or magnesium alloys, said alloys possibly containing fibres of ceramic materials.

One skilled in the art of casting in a permanent mould is well aware of processes for the pressure casting of metal parts using in particular cold-chamber machines in which an alloy in the liquid state which is disposed in a sleeve which is fixed with respect to a mould or die is pushed by a piston into a cavity in a relatively short period of time.

The application of a pressure which can exceed $10^2$MPa then provides for a feed of liquid alloy to the part during the solidification thereof.

Such processes make it possible to produce parts with a high degree of dimensional accuracy with a very good surface condition, which makes it unnecessary subsequently to have recourse to a costly machining operation. In addition, the absence of risers and gates leads to a much better casting result than in the case of gravity casting. Finally, there is no need to carry out heat treatments by virtue of the good mechanical characteristics afforded by the crude cast components.

All those advantages make pressure casting a process which is being more and more widely used in particular in foundry operations involving light metals such as aluminium and magnesium.

However, certain difficulties have appeared when that casting process was extended to fresh products such as for example aluminium-lithium alloys, certain alloys of magnesium and composite products containing, besides those metals, fibres of ceramic materials.

It is known in fact that aluminium-lithium and magnesium alloys are particularly sensitive to oxidation and that the fibre-metal bond in the composite materials may be greatly weakened by the presence in the metal of oxides or other compounds resulting from an effect of the environment.

Now, most of the cold-chamber pressure casting machines have not hitherto taken into account that interaction between the cast products and the air.

Thus for example in the pressure casting apparatus described in U.S. Pat. No. 4,088,178, the feed of metal to the sleeve is effected by disconnecting the injection system from the mould or die and then inclination with respect to the vertical and filling of the sleeve by means of a ladle. It will be apparent that, when operating in that manner, it is not possible to produce suitable parts from alloys which are very easy to oxidize.

Prior to the preceding patent, U.S. Pat. No. 3,058,179, with a completely different aim in mind, had already set forth an apparatus which partly deals with the problem of interaction. In fact, in that case the sleeve is supplied in a condition of being protected from the air by means of a conduit which dips into a sealed vessel containing the metal to be cast in the liquid state and provided in its upper part with an intake for an inert gas under pressure, by means of which an increased pressure is created at the surface of the liquid to cause it to pass into the sleeve. In that arrangement, contact between the liquid metal and the atmosphere is avoided at the moment of filling of the container but that does not solve the problem of interaction. Indeed, in the upward movement of the piston in the container in order to compress the metal in the cavity, the air contained in the cylinder in which the piston is slidable and which surrounds the rod of the piston is in communication with the conduit for introducing liquid into the container. As at that time the metal contained in the conduit begins to flow towards the vessel again, it draws in that air and is oxidized as a result.

Another difficulty which is an even greater preoccupation is as follows: due to the high speed of movement of the piston (more than 0.5 meters/second), communication of the conduit with the atmosphere of the cylinder for the piston is very quick so that initially the metal has not yet begun to flow back towards the vessel when that communication occurs. That then results in a flow of metal within the cylinder which quickly compromises proper operation of the piston and in most cases results in stoppage of the machine. It is to remedy those difficulties that the applicants sought and discovered a new apparatus.

That apparatus is to be found within the framework of U.S. Pat. No. 3,058,179, that is to say it combines with the pressure casting apparatus a feed of metal by way of a conduit which dips into a vessel from which the metal is discharged towards an injection sleeve by the action of a gas pressure $P_2$. It is characterised in that the said conduit is provided at a point on its side near the container with an inert gas duct and a pocket under a gas pressure $P_1$ dependent on the position of the piston and $P_2$.

Under those conditions, assuming that the mould or die is ready to be fed, the casting takes place in the following fashion: Inert gas is blown under a pressure $P_1$ into the conduit. As the piston is then in a down position, the communicaiton between the injection sleeve and the conduit exists and that gas can spread into the cavity of the die, thus purging it of the air that it contains.

Then, an increased pressure is established at the surface of the bath of metal contained in the vessel. In order for the metal to rise in the conduit, that increased pressure $P_2$ must then be higher than $P_1$. When the metal has filled the conduit and the sleeve the piston rises rapidly to provide for compression of the metal. As soon as the piston masks the communicating orifice between the conduit and the container, which is detected by means of any sensor or detector, the gas is immediately blown in in such a way that $P_1$ becomes higher than $P_2$. The metal is delivered to the vessel and any flow of metal towards the cylinder is prevented at the moment at which the rod of the piston appears at the level of the orifice. That gas then fills the entire volume left between the metal and the cylinder and the pressure thereof discharges the air which comes from the cylinder of the piston. It should be noted that the length of the piston must be greater than the height of the orifice communicating the conduit with the sleeve so that the metal is delivered before the cylinder is communicated with the conduit. Subsequently, when the piston is going to move down again and unmask the orifice, the gas which is then blown in under low pressure will be introduced into the sleeve and will prevent any intake of air from the die which is then open, until the value of $P_2$ which has been reduced to 0 to facilitate the return flow of the metal to the vessel increases again to start off a fresh casting cycle.

Moreover, there has been provided at the point at which the gas is blown in, a kind of pocket which is placed on the top of the conduit and within which a gas cushion is maintained to prevent metal from passing into the system for blowing in the gas. The pocket is provided with a probe which detects an abnormal reduction in the height of the gas cushion and then causes the opening of a particular loaded valve in order to provide the make-up of pressure required for maintaining the desired height.

Establishment of the appropriate pressure differences $P_1$ and $P_2$ is effected by means of a differential manometer controlled by any sensor or position detector and which acts on the opening and closing of appropriate valves.

The value of $P_2$ must be at least equal to the value of the metallostatic pressure applied by the metal when it fills the cavity. As regards the difference $P_1-P_2$, it is of the order of 0.01 MPa.

The invention can be illustrated by means of the accompanying drawings in which.

Figure 1:
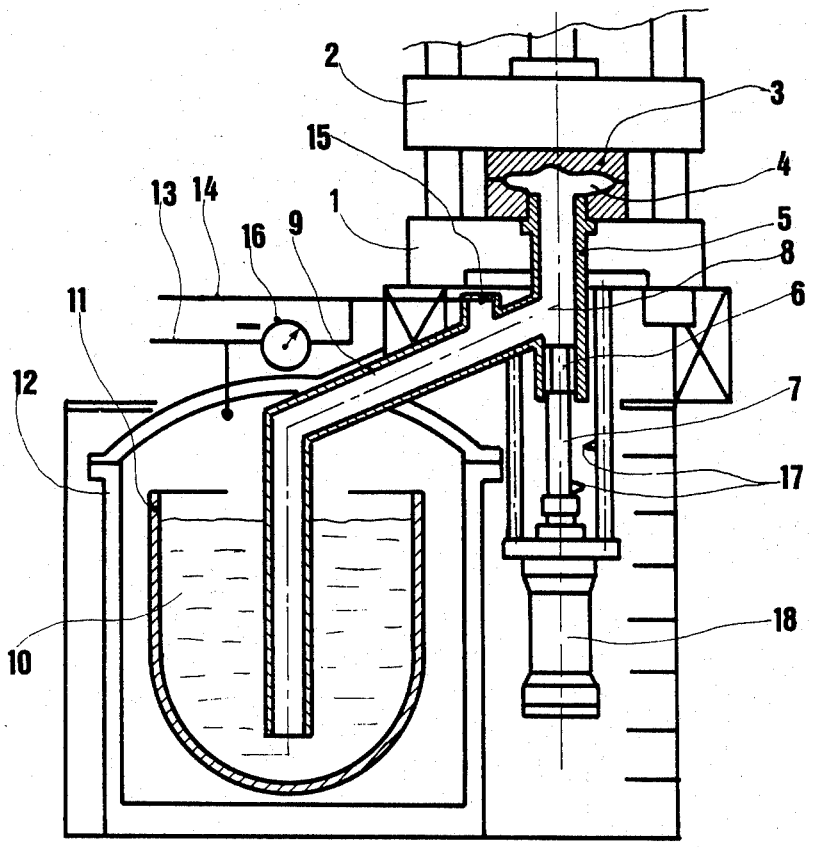
FIG. 1 is a view in vertical axial section of a casting installation.

Referring to FIG. 1, shown therein is the lower fixed plate 1 and the upper movable plate 2 of a vertical pressure casting machine. Disposed between those plates is the mould or die 3 having a cavity 4. The lower plate is fitted with an injection arrangement formed by the injection sleeve 5 in which slides the piston 6 which is supported by the rod 7 which is caused to move with a reciprocating movement by the jack 18. The sleeve 5 is connected by way of the orifice 8 to the conduit 9 which dips into the bath 10 of metal to be cast, contained in the crucible 11 disposed in the sealed vessel 12 which can be put under pressure by way of the gas intake 13 in order to pass the metal by way of the conduit 9 to the sleeve 5. According to the invention, an inert gas is injected in the duct 14 at a point 15 on the conduit 9 in accordance with a pressure linked to the pressure obtaining in the vessel in dependence on the position of the piston as detected by the sensor 17, which pressure can be controlled by the differential regulator manometer 16.

Figure 2:
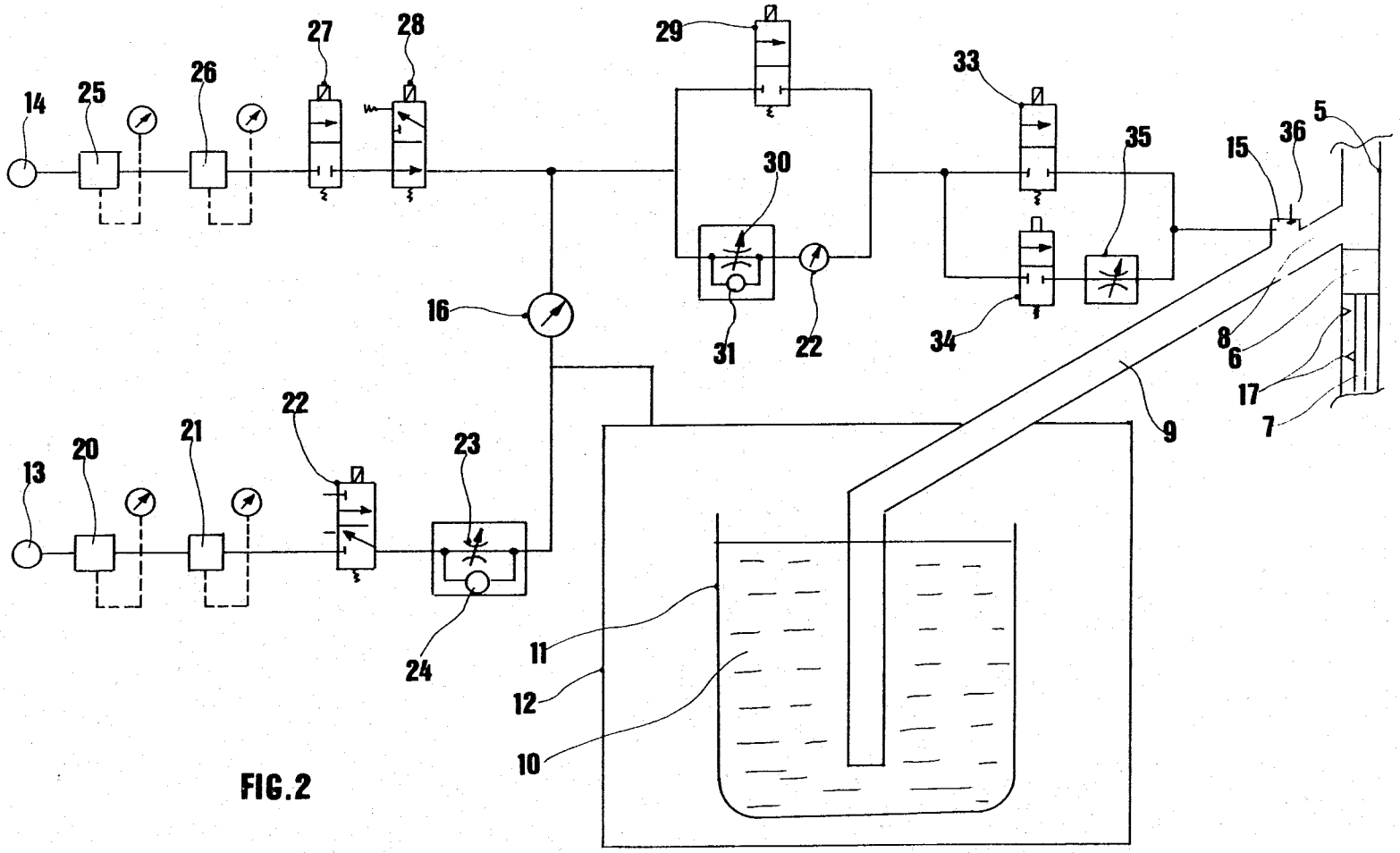
FIG. 2 is a diagrammatic view of the installation for the feed of gas to the vessel and the conduit.

FIG. 2 shows the components of FIG. 1, namely the container 5, the piston 6, the rod 7, the orifice 8, the conduit 9, the metal bath 10, the crucible 11, the vessel 12, the gas intake 13, the duct 14, the injection point 15, the manometer 16 and the sensor 17.

Besides those elements, also illustrated are all those which permit the installation to be operated. In the direction of circulation of the gases, they are as follows:

on the gas intake 13 :
- the high-pressure pressure-reducer 20
- the low-pressure pressure-reducer 21
- the electrically operated valve 22 which provides either for the flow of gas to the vessel or communication of the vessel with the air
- the flow controller 23
- the non-return valve 24 on the duct 14 :
- the high-pressure pressure-reducer 25
- the low-pressure pressure-reducer 26
- the electrically operated two-way valve 27
- the electrically operated three-way valve 28, one of its ways communicating with the atmosphere. That pair of valves makes it possible to regulate the pressure $P_1$ in the conduit with respect to the pressure $P_2$ in the vessel by way of the differential manometer 16.

In fact, if $P_1$ is correct, those two valves are closed, if $P_1$ is too low, the valve 27 is open and the communication with the air of the valve 28 is closed; if $P_1$ is excessively high, the valve 27 is closed and the communication of the valve 28 with the air is open.

- the electrically operated valve 29, opening of which permits a substantial flow rate of injected gas
- the flow controller 30
- the non-return valve 31
- the flow rate meter 32
- the electrically operated valve 33 which provides for stoppage or passage of injected gas towards 15
- the electrically operated valve 34 with its flow rate controller 35 which after a failure of the injected gas circuit opens only if the probe 36 indicates an upward movement of metal at the level of the point 15 and the risk of blockage of the duct.

In the course of a casting cycle, the installation operates in the following fashion:

1. The die being open to extract the part, the vessel is at atmospheric pressure by way of the valve 22, the piston is in the down position, the valve 28 is closed, and the differential manometer 16 is at the position $P_1>P_2$ so that a low flow rate of gas arrives at 15 by way of the flow rate controller 30 and the valve 33.

2. The die is closed again, ready for a fresh injection operation. The situation of the preceding elements remains identical so that the gas sweeps through the cavity and expels the air therefrom.

3. The injection order being given, the valve 33 closes, isolating the chamber 15, thereby nullifying the condition $P_1>P_2$ while the valve 29 opens. The valve 22 provides for the flow of the gas to the vessel and causes the liquid metal to rise towards the container. When the piston begins its upward movement, the valve 29, being open, is ready to provide the sufficient gas pressure $P_1>P_2$ to prevent the introduction of metal into the circuit for injecting gas by the formation of a protective cushion at the point 15.

4. As soon as the piston closes off the orifice 8, the valve 33 is opened so that $P_1$ becomes higher than $P_2$ and accelerates the return flow of metal towards the vessel to prevent any flow of metal into the cylinder at the time at which the piston rod appears at the location of the orifice 8 and any intake of air from said cylinder.

5. The piston continues its movement in an upward direction during solidification of the part while the valve 22 is communicated with the air to cause $P_2$ to fall. $P_1$ is modulated on $P_2$ so as constantly to have $P_1>P_2$.

6. The valves remaining in the same position, the die is opened and the piston in its rising movement ejects the injection pellet.

7. The piston returns to the down position. At the moment at which it opens the orifice 8, the valve 29 closes so that a slight gas pressure is produced by means of the controller 30 in order to purge the container.

The casting cycle is then started again.

It will be clear that all those operations are made automatic by using regulating and control apparatuses which are well known to the man skilled in the art.

I claim:

1. Apparatus for pressure casting having a cold chamber for the manufacture of metal parts, comprising a lower fixed plate (1); an upper movable plate (2); a die (3) disposed between said upper plate and said lower plate and having a cavity in the form of a part to be cast, said lower plate being provided with an injection means for liquid metal comprising an injection sleeve (5) having a piston (6) supported on a rod (7) slidable therein; a sealed vessel (12) for containing liquid metal; conduit means (9) for connecting said vessel with said injection sleeve by way of an orifice (8) in the sleeve; a gas inlet in the vessel adapted to be connected to a source of gas; means for regulating the flow of gas through said inlet for selectively placing the liquid metal in the vessel under a gas pressure P2, and thereby causing the flow of liquid metal in said conduit towards said injection sleeve; a second gas inlet, located in said conduit near the orifice, said second gas inlet adapted to be connected to a source of gas; means for regulating the flow of gas through the second gas inlet to selectively create a gas pressure P1 in a pocket adjacent to said second gas inlet, depending on the position of said piston and the pressure P2, whereby the flow of liquid metal onto said rod and the entry of air into said conduit is prevented.

2. Apparatus according to claim 1, wherein said means for regulating the flow of a gas through the second gas inlet includes means for regulating P1 to be greater than P2 when the forward surface of the piston is between the orifice and said die.

3. Apparatus according to claim 1, wherein said means for regulating the flow of a gas through the second gas inlet includes means for reducing P1 when the forward surface of the piston is not between the orifice and said die.

4. Apparatus according to claim 1, additionally comprising a differential manometer (16) and a sensor (17) for effecting the difference in pressure between P1 and P2.

* * * * *